US009469043B2

(12) United States Patent
Sugizaki et al.

(10) Patent No.: US 9,469,043 B2
(45) **Date of Patent: *Oct. 18, 2016**

(54) BIASING ASSEMBLY FOR A PUNCHING DEVICE

(75) Inventors: Fumitaka Sugizaki, Batavia, NY (US); Hitoshi Iizuka, Alexander, NY (US); Edward A. Dries, LeRoy, NY (US)

(73) Assignee: Amada Tool America, Inc., Batavia, NY (US)

( * ) Notice: Subject to any disclaimer, the term of this patent is extended or adjusted under 35 U.S.C. 154(b) by 997 days.

This patent is subject to a terminal disclaimer.

(21) Appl. No.: 12/613,151

(22) Filed: Nov. 5, 2009

(65) Prior Publication Data

US 2010/0095825 A1 Apr. 22, 2010

Related U.S. Application Data

(63) Continuation of application No. 10/945,929, filed on Sep. 22, 2004, now Pat. No. 7,698,979.

(51) Int. Cl.
*B26D 7/26* (2006.01)
*B21D 28/34* (2006.01)
(Continued)

(52) U.S. Cl.
CPC ..... *B26D 7/2614* (2013.01); *B21D 28/26* (2013.01); *B21D 28/34* (2013.01); *B26F 1/14* (2013.01); *B21D 28/346* (2013.01);
(Continued)

(58) Field of Classification Search
CPC .... B21D 28/346; B21D 28/26; B21D 28/34; B21D 45/006; B26D 7/2614; B26D 7/2621; B26F 1/02; B26F 1/14; Y10T 83/2155; Y10T 83/2159; Y10T 83/2166; Y10T 83/8785; Y10T 83/8867; Y10T 83/9423; Y10T 83/9428; Y10T 83/9476
USPC ..... 83/136–143, 588, 684–686, 698.91, 83/640
See application file for complete search history.

(56) References Cited

U.S. PATENT DOCUMENTS 939,958 A 11/1909 Koelsch
2,168,377 A * 8/1939 Wales ..... 83/140
(Continued)

FOREIGN PATENT DOCUMENTS

| | | |
|---|---|---|
| EP | 0 532 147 A1 | 3/1993 |
| JP | 2002-282962 | 10/2002 |
| WO | 94/07625 | 4/1994 |

OTHER PUBLICATIONS

Advertisement for Amada, Ex-Tooling for Thin Type B Sta; Amada, Japan; 2000; 1 page.

*Primary Examiner* — Clark F Dexter
(74) *Attorney, Agent, or Firm* — Blank Rome LLP

(57) ABSTRACT

A biasing assembly for a punching device that includes a punch support member adapted to support a punch and including a head portion and a main portion extending from the head portion. The main portion has a recessed surface. A retaining member is coupled to the punch support member with the punch support member being slidable with respect to the retaining member. A coupling member is disposed between the main portion of the punch support member and the retaining member. A portion of the coupling member engages the recessed surface. A biasing member is supported between the head portion of the punch support member and the retaining member. The punch support member is movable between at least first and second positions with respect to the coupling member.

14 Claims, 3 Drawing Sheets

(51) Int. Cl.

| | |
|---|---|
| ***B26F 1/14*** | (2006.01) |
| ***B21D 28/26*** | (2006.01) |
| *B21D 45/00* | (2006.01) |
| *B26F 1/02* | (2006.01) |

(52) U.S. Cl.

CPC ..... *B21D 45/006* (2013.01); *B26F 1/02* (2013.01); *Y10T 83/2155* (2015.04); *Y10T 83/2159* (2015.04); *Y10T 83/2166* (2015.04); *Y10T 83/8785* (2015.04); *Y10T 83/8867* (2015.04); *Y10T 83/9423* (2015.04); *Y10T 83/9428* (2015.04); *Y10T 83/9476* (2015.04)

(56) References Cited

U.S. PATENT DOCUMENTS

| | | | | |
|---|---|---|---|---|
| 2,468,998 | A | | 5/1949 | Parsons |
| 2,999,407 | A | | 9/1961 | DeFrangesco |
| 3,147,657 | A | | 9/1964 | Williamson |
| 3,149,524 | A | | 9/1964 | Vecchi |
| 3,211,035 | A | | 10/1965 | Whistler, Sr. et al. |
| 3,335,627 | A | * | 8/1967 | Smelts ..... 83/140 |
| 3,741,056 | A | | 6/1973 | Saladin |
| 3,935,772 | A | | 2/1976 | Demus et al. |
| 3,958,476 | A | | 5/1976 | Bartha |
| 4,092,888 | A | | 6/1978 | Wilson |
| 4,141,264 | A | | 2/1979 | Weisbeck |
| RE29,950 | E | | 4/1979 | Bartha |
| RE29,958 | E | | 4/1979 | Cady |
| 4,440,052 | A | | 4/1984 | Weisbeck |
| 4,457,196 | A | | 7/1984 | Cady |
| 4,993,295 | A | | 2/1991 | Dacey, Jr. |
| 5,131,303 | A | | 7/1992 | Wilson et al. |
| 5,301,580 | A | | 4/1994 | Rosene et al. |
| 5,410,927 | A | | 5/1995 | Omata et al. |
| 5,553,524 | A | | 9/1996 | Fujita |
| 5,839,341 | A | * | 11/1998 | Johnson et al. ..... 83/530 |
| 5,884,546 | A | | 3/1999 | Johnson |
| 6,047,621 | A | | 4/2000 | Dries et al. |
| 6,311,594 | B1 | | 11/2001 | Ootsuka |
| 6,460,387 | B1 | | 10/2002 | Seto |
| 2002/0189420 | A1 | | 12/2002 | Rosene et al. |

* cited by examiner

BIASING ASSEMBLY FOR A PUNCHING DEVICE

RELATED APPLICATION

This application is a continuation of commonly assigned U.S. patent application Ser. No. 10/945,929, filed, Sep. 22, 2004, now U.S. Pat. No. 7,698,979.

FIELD OF THE INVENTION

The present invention relates to a biasing assembly for use in a punching device that facilitates adjustment of the punch and remains assembled even after removal of the punch.

BACKGROUND OF THE INVENTION

In conventional high speed punching machines, the cutting end of the punch after a period of use requires sharpening, typically by grinding. Sharpening, however, shortens the punch. To ensure proper positioning after sharpening, the punch must be readjusted. Often conventional punching machines require complete disassembly of their spring assemblies in order to sharpen and adjust the punch. Disassembly of the spring assemblies is time consuming and frequently requires the use of special tools. Moreover, the spring assemblies of conventional punching machines include many parts that require additional labor to assemble.

Examples of conventional punching machines include U.S. Pat. No. 4,440,052 to Weisbeck; U.S. Pat. No. 4,141,264 to Weisbeck; U.S. Pat. No. 4,092,888 to Wilson; U.S. Pat. No. 3,958,476 to Bartha; U.S. Pat. No. 3,741,056 to Saladin; and U.S. Pat. No. 939,958 to Koelsch; the subject matter of each of which is hereby incorporated by reference.

SUMMARY OF THE INVENTION

Accordingly, an object of the present invention is to provide a biasing assembly for a punching device that remains assembled upon removal of the punch.

Another object of the present invention is to provide a biasing assembly for a punching device that facilitates adjustment of the punch after sharpening the punch.

Yet another object of the present invention is to provide a biasing assembly for a punching device that requires a minimal number of parts.

The foregoing objects are attained by a biasing assembly for a punching device that comprises a punch support member adapted to support a punch and includes a head portion and a main portion extending from the head portion. The main portion has a recessed surface extending substantially around the main portion. A retaining member is coupled to the punch support member with the punch support member being slidable with respect to the retaining member. A coupling member is disposed between the main portion of the punch support member and the retaining member. A portion of the coupling member substantially surrounds the recessed surface, wherein the coupling member is stationary with respect to the retaining member. A biasing member is supported between the head portion of the punch support member and the retaining member. Whereby the punch support member is movable between at least first and second positions with respect to the coupling member, such that in the first position, the coupling member engages a first area of the recessed surface of the punch support member, and in the second position, the coupling member engages a second area of the recessed surface, different from the first area.

The foregoing objects are also attained by a biasing assembly for a punching device that comprises a punch support member adapted to support a punch and includes a head portion and a main portion extending from the head portion. The main portion has a recessed surface extending substantially around the main portion. A retaining member is coupled to the punch support member with the punch support member being slidable with respect to the retaining member. The retaining member is a collar surrounding the main portion of the punch support member. A coupling member is disposed between the main portion of the punch support member and the retaining member. A portion of the coupling member engages substantially around the recessed surface wherein the coupling member is stationary with respect to the retaining member. A biasing member is supported between the head portion of the punch support member and the retaining member. Whereby the punch support member is movable between at least first and second positions with respect to the coupling member, such that in the first position, the coupling member engages a first area of said recessed surface of said punch support member, and in said second position, the coupling member engages a second area of the recessed surface, different from the first area.

Other objects, advantages and salient features of the invention will become apparent from the following detailed description, which, taken in conjunction with the annexed drawings, discloses a preferred embodiment of the present invention

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE INVENTION

Figure 1:
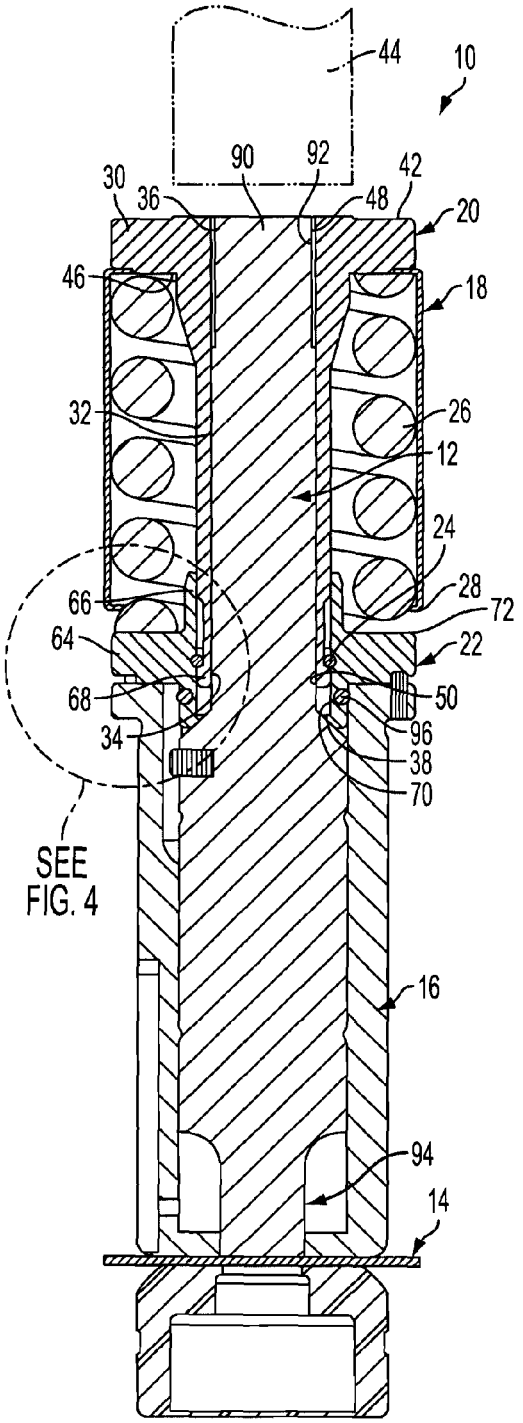
FIG. 1 is a side elevational view in section of a biasing assembly of a punching device in accordance with an embodiment of the invention, showing the biasing assembly of the punching device in a resting position.

Referring to FIGS. 1-6, a punching device 10, such as turret punch press, generally includes a punch 12 for punching a work piece 14, such as sheet metal, a punch guide 16, and a biasing assembly 18 that assists in the linear movement of punch 12. Punch 12 can be removed from biasing assembly 18 and mounted back into assembly 18 without disassembling the components thereof. This allows for easy removal and adjustment of punch 12, such as when sharpening of the punch 12 is required.

Figure 2:
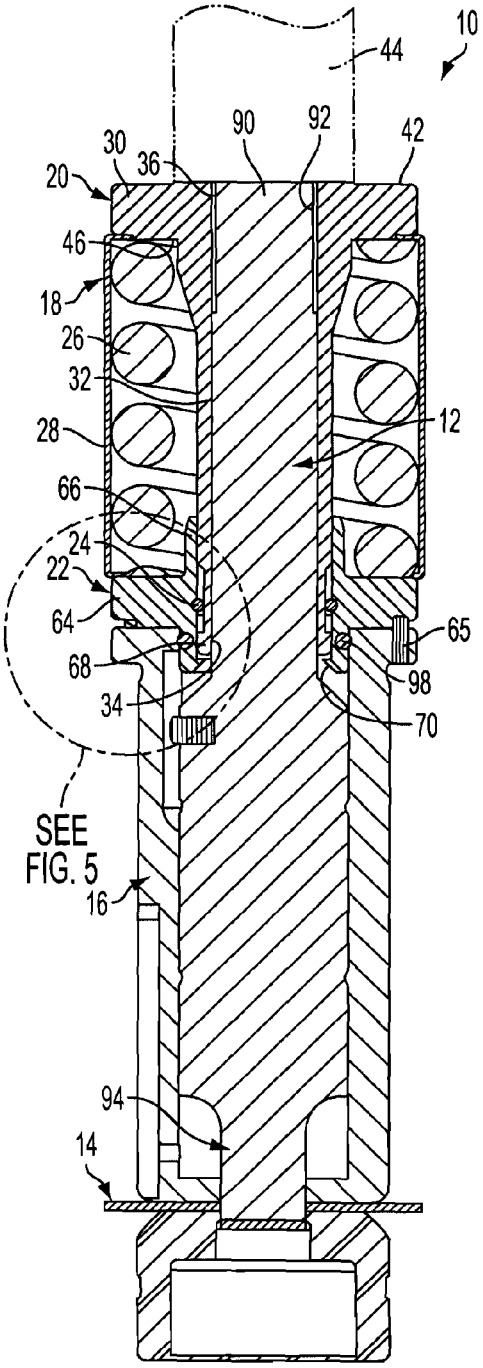
FIG. 2 is a side elevational view in section of the biasing assembly of the punching device illustrated in FIG. 1, showing the biasing assembly in a compressed position.
Figure 3:
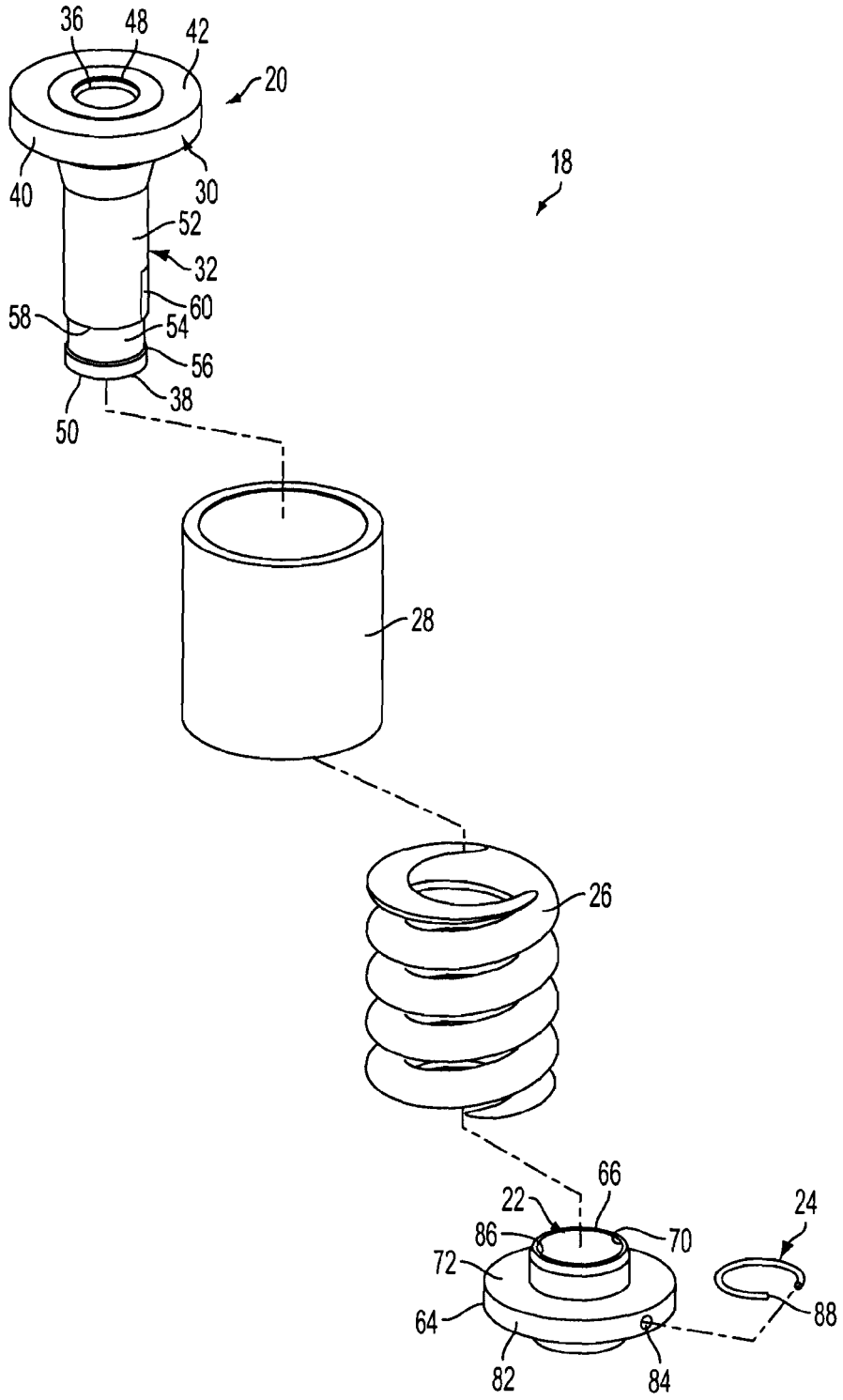
FIG. 3 is an exploded perspective view of the biasing assembly illustrated in FIGS. 1 and 2.

As seen in FIGS. 1-3, biasing assembly 18, in accordance with the present invention, includes minimal components. In particular, biasing assembly 18, includes a punch support member 20, a retaining member (e.g. a collar) 22, a coupling member 24 coupling the punch support member 20 and the retaining member 22, and a biasing member 26 disposed between the punch support member 20 and retaining member 22. A cover sleeve 28 can be provided to cover biasing member 26, but is not required.

Punch support member 20 includes a head portion 30 and a main portion 32 extending therefrom forming a generally T-shaped member. A substantially continuous inner bore 34 extends through punch support member 20 between first and second ends 36 and 38 of member 20. Head and main portions 30 and 32 can either form a one-piece unitary member or be separate pieces attached in any known manner. Head portion 30 is substantially disc-shaped and includes an outer surface 40 that can be knurled. As seen in FIGS. 1 and 2, opposite main portion 32, head portion 30 includes an exposed surface 42 that engages a striker 44 of the punching device 10 for compressing biasing assembly 18 and linearly moving punch 12. Opposite the exposed surface 42 of head portion 30 is an engaging surface 46 that engages biasing member 26. An opening 48 of head portion 30 at the first end 36 of punch support member 20 is continuous with inner bore 34.

Figure 4:
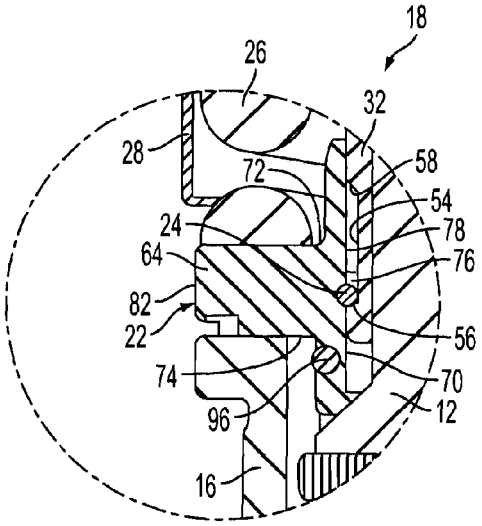
FIG. 4 is an enlarged partial view of the biasing assembly of the punching device illustrated in FIG. 1, showing a coupling member in one position with respect to a punch support member of the biasing assembly.
Figure 5:
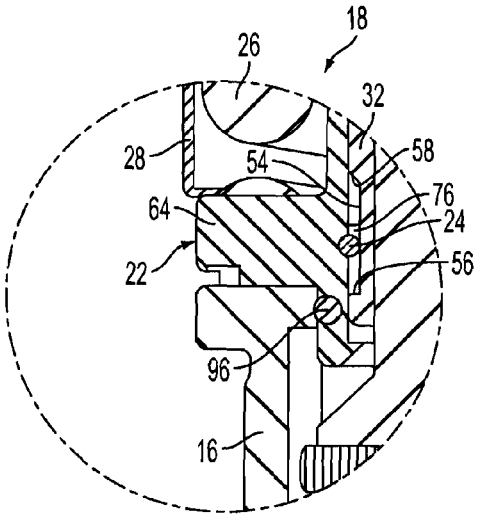
FIG. 5 is an enlarged partial view of the biasing assembly of the punching device illustrated in FIG. 2, showing the coupling member in another position with respect to the punch support member.

Main portion 32 of punch support member 20 is substantially tubular with an end opening 50 continuous with inner bore 34. The outer surface 52 of main portion 32 includes a recessed area 54 extending around main portion 32 and that is defined between first and second shoulders 56 and 58, as seen in FIGS. 3-5. The outer surface 52 also includes a stopping area 60 which is substantially flat, as seen in FIG. 3.

As seen in FIGS. 1-3, retaining member 22 has a collar shape with a main retaining portion 64, first and second extensions 66 and 68 extending from opposite sides of main retaining portion 64, and a generally continuous inner bore 70 (FIG. 6) extending through main retaining portion 64 and extensions 66 and 68. Main retaining portion 64 is wider than first and second extensions 66 and 68 and includes an engaging surface 72 facing first extension 66 for engaging biasing member 26, and an opposite guide engaging surface 74 facing second extension 68, as seen in FIG. 4. As seen in FIG. 3, the main retaining portion 64 has a radial width that is wider than the extension 66. Main retaining portion 64 preferably receives pins schematically shown at 65 (FIGS. 1 and 2) of punch guide 16 and abuts punch guide 16 at surface 74, thereby attaching retaining member 22 to punch guide 16. However, retaining member 22 can be attached to punch guide 16 in any known manner. An inner radial groove 76 of main retaining portion 64 is formed in the inner surface 78 defined by inner bore 70 for receiving coupling member 24, as seen in FIGS. 4 and 5.

Figure 6:
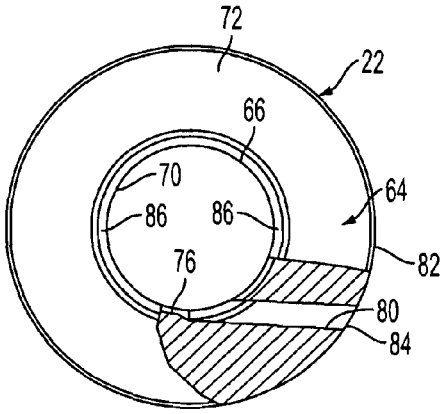
FIG. 6 is a top plan view in partial section of a retaining member of the biasing assembly illustrated in FIGS. 1 and 2, showing a passageway extending through the retaining member.

As seen in FIG. 6, a passageway 80 extends from the outer surface 82 of main retaining portion 64 to inner groove 76. An access opening 84 is provided in outer surface 82, as seen in FIG. 3, to allow coupling member 24 to be inserted into passageway 80 and into inner groove 76. As seen in FIG. 3, first extension 66 of retaining member 22 includes a stopping area 86 (FIG. 6) that is substantially flat and cooperates with stopping area 60 of punch support member 20 to limit rotation of retaining member 22 and punch support member 20 with respect to one another and provide a positive lock therebetween.

As seen in FIG. 3, coupling member 24 can be a substantially ring shaped clip with a cut-out section 88 that allows installation of coupling member 24 into retaining member 22. Coupling member 24 is preferably made of a metal wire but can be formed of any resilient material. Biasing member 26 can be a compression spring, as seen in FIG. 3, or any type of biasing structure.

Assembly and Operation

Referring to FIGS. 1-6, biasing assembly 18 of punching device 10 is assembled in accordance with the present invention by disposing biasing member 26 around main portion 32 of punch support member 20 and between head portion 30 and main retaining portion 64 of retaining member 22. Main portion 32 of punch support member 20 is slidably inserted through inner bore 70 of retaining member 22 with biasing member 26 abutting engaging surface 46 of head portion 30 and engaging surface 72 of main retaining portion 64.

Coupling member 24 is inserted through access opening 84 of main retaining portion 64, into passageway 80, and into inner groove 76 of retaining member 22. A portion of coupling member 24 is disposed in recessed area 54 of main portion 32 of punch support member 20 between shoulders 56 and 58, as best seen in FIGS. 4 and 5. Coupling member 24 abuts first shoulder 56 of recessed area 54, as seen in FIG. 4, thereby substantially preventing disassembly of punch support member 20 and retaining member 22. Biasing member 26 applies force to both punch support member 20 and retaining member 22. Stopping surface 60 of main portion 32 of punch support member 20 and stopping surface 86 of first extension 66 of retaining member 22 engage one another. Because both surfaces are substantially flat, punch support member 20 and retaining member 22 are prevented from rotating with respect to one another, thereby providing a positive lock between the two members. As such, no additional fasteners, such as a set screw, are required to lock punch support member 20 and retaining member 22. Cover sleeve 28 surrounds biasing member 26.

Punch 12 is received in inner bore 34 of punch support member 20 and inner bore 70 of retaining member 22 with a first end 90 of punch 12 being threadably engaged with threads 92 of inner bore 34 near head portion 30 of punch support member 20, as seen in FIGS. 1 and 2. An opposite second end 94 of punch 12 extends through guide 16 to punch workpiece 14, as seen in FIG. 2.

Biasing assembly 18 and punch guide 16 are connected by inserting pins of guide 16 through corresponding holes (schematically shown at 65 in FIGS. 1 and 2) in guide engaging surface 74 of main retaining portion 64 of retaining member 22 Also, an O-ring 96 disposed around second extension 68 of retaining member 22 can be employed to connect guide 16 and assembly I 8. In particular, O-ring 96 engages a groove 98 in guide 16, as seen in Figs. and 2. However, any known attachment can be used to couple retaining member 22 of biasing assembly 18 and guide 16.

During operation, the striker 44 engages exposed surface 42 of head portion 30 of punch support member 20 forcing biasing member 26 to compress, thereby moving punch support member 20 towards guide 16 with the second end 94 of punch 12 punching work piece 14, as seen in FIG. 2. First shoulder 56 of recessed area 54 of punch support member 20 moves away and is spaced from coupling member 24 as biasing assembly 18 is being compressed, as seen in FIG. 5. Biasing member 18 can be compressed until coupling member 24 abuts second shoulder 58 of the recessed area 54. Once work piece 14 has been punched and the striker 44 is released, biasing member 26 forces punch support member 20 back away from guide 16 until coupling member 24 abuts first shoulder 56 of punch support member 20.

If second end 94 of punch 12 becomes worn and requires sharpening, punch 12 can be easily removed from biasing assembly 18 and replaced and punch support member 20, retaining member 22 and biasing member 26 will remain assembled. Punch 12 is simply unscrewed from punch support member 20 and removed from biasing assembly 18.

Punch support member 20, retaining member 22 and biasing member 26 remain assembled due to coupling member 24. Punch 12 can then be sharpened and installed back into biasing assembly 18. Sharpening of punch 12 often reduces the length of punch 12. The threads 92 of inner bore 34 of punch support member 20 allow for easy adjustment of punch 12 to compensate for the shorter length of punch 12. Specifically, punch 12 is threaded into the threads 92 of inner bore 34 so that punch 12 meets or is close to work piece 14 prior to being moved by striker 44, as seen in FIG. 1. Punch 12 is adjusted by threading first end 90 of punch 12 into inner bore 34 such that the shorter punch 12 is, the fewer threads 92 of inner bore 34 engage punch 12.

While a particular embodiment has been chosen to illustrate the invention, it will be understood by those skilled in the art that various changes and modification can be made therein without departing from the scope of the invention as defined in the appended claims.

What is claimed is:

1. A biasing assembly for a punching device, comprising:

a punch support member adapted to support a punch and including a head portion and a main portion extending from said head portion, said main portion having a recessed surface extending substantially around said main portion;

a retaining member coupled to said punch support member with said punch support member being slidable with respect to said retaining member, said retaining member is a collar surrounding said main portion of said punch support member, said collar having a main retaining portion and at least one extension, wherein said main retaining portion has a radial width that is wider than said at least one extension, such that said main retaining portion has an engaging surface disposed radially outwardly of said at least one extension;

a coupling member disposed between said main portion of said punch support member and said retaining member, said coupling member substantially surrounding said recessed surface, wherein said coupling member is fixed with respect to said retaining member, said coupling member being a substantially ring-shaped clip; and a biasing member supported between said head portion of said punch support member and said retaining member, said biasing member engaging said engaging surface of said main retaining portion, whereby said punch support member is movable between at least first and second positions with respect to said coupling member, such that in said first position, said coupling member engages a first area of said recessed surface of said punch support member, and in said second position, said coupling member engages a second area of said recessed surface, different from said first area.

2. A biasing assembly according to claim 1, wherein said biasing member is a compression spring.

3. A biasing assembly according to claim 1, wherein said punch support member includes internal threads for engaging the punch.

4. A biasing assembly according to claim 1, wherein said main portion is substantially tubular and said head portion is substantially disc shaped, and said main and head portions having a continuous inner bore.

5. A biasing assembly according to claim 1, further comprising a cover sleeve substantially surrounding said biasing member.

6. A biasing assembly for a punching device, comprising:

a punch support member adapted to support a punch and including a head portion and a main portion extending from said head portion, said main portion having a recessed surface extending substantially around said main portion;

a retaining member coupled to said punch support member with said punch support member being slidable with respect to said retaining member, said retaining member is a collar surrounding said main portion of said punch support member, said collar having a main retaining portion and at least one extension, wherein said main retaining portion has a radial width that is wider than said at least one extension, such that said main retaining portion has an engaging surface disposed radially outwardly of said at least one extension;

a coupling member disposed between said main portion of said punch support member and said retaining member, a portion of said coupling member engaging substantially around said recessed surface wherein said coupling member is fixed with respect to said retaining member; and a spring biasing member supported between said head portion of said punch support member and said retaining member, said spring biasing member engaging said engaging surface of said main retaining portion, whereby said punch support member is movable between at least first and second positions with respect to said coupling member, such that in said first position, said coupling member engages a first area of said recessed surface of said punch support member, and in said second position, said coupling member engages a second area of said recessed surface, different from said first area.

7. A biasing assembly according to claim 6, wherein said main portion of said punch support member includes an inner bore for receiving the punch.

8. A biasing assembly according to claim 6, wherein said retaining member includes an inner groove that receives said coupling member.

9. A biasing assembly according to claim 6, wherein said punch support member is a unitary one-piece member.

10. A biasing assembly according to claim 6, wherein said coupling member is a substantially ring shaped clip.

11. A biasing assembly according to claim 6, wherein said spring biasing member is a compression spring.

12. A biasing assembly according to claim 6, wherein said punch support member includes internal threads for engaging the punch.

13. A biasing assembly according to claim 6, wherein said main portion is substantially tubular and said head portion is substantially disc shaped, and said main and head portions having a continuous inner bore.

14. A biasing assembly according to claim 6, further comprising a cover sleeve substantially surrounding said biasing member.

* * * * *